US005540169A

United States Patent [19]

Davis et al.

[11] Patent Number: 5,540,169

[45] Date of Patent: Jul. 30, 1996

[54] PONTOONS AND PONTOON VESSEL

[75] Inventors: W. John Davis, Hudson Bay; Orville Olm; Bernard Seymore, both of Saskatoon, all of Canada

[73] Assignee: Jaddco Inc., Hudson Bay, Canada

[21] Appl. No.: 240,557

[22] Filed: May 11, 1994

[51] Int. Cl.[6] ..... B63B 1/00

[52] U.S. Cl. ..... 114/61; 114/352

[58] Field of Search ..... 114/351, 352, 114/353, 354, 61, 123, 288, 292

[56] References Cited

U.S. PATENT DOCUMENTS

| | | | |
|---|---|---|---|
| 3,119,128 | 1/1964 | Edmonson | 114/352 |
| 3,629,884 | 12/1971 | Brown | 114/61 |
| 3,673,976 | 7/1972 | Reynolds | 114/61 |
| 3,796,175 | 3/1974 | Ford, Jr. et al. . | |
| 3,812,805 | 5/1974 | Forssell et al. | 114/61 |
| 3,953,904 | 5/1976 | Fry . | |
| 3,968,532 | 7/1976 | Bailey | 114/352 |
| 4,478,167 | 10/1984 | Hart | 114/352 |
| 4,557,210 | 12/1985 | Gerwin . | |
| 4,562,786 | 1/1986 | Pruonto | 114/61 |
| 4,777,898 | 10/1988 | Faulkner . | |
| 4,827,859 | 5/1989 | Powell . | |
| 5,061,215 | 10/1991 | Walls . | |
| 5,301,629 | 4/1994 | Kleyh et al. | 114/352 |

*Primary Examiner*—Stephen Avila

*Attorney, Agent, or Firm*—Murray E. Thrift; Adrian D. Battison

[57] ABSTRACT

A pontoon boat is manufactured using sectional pontoons of rotationally molded thermoplastic material. The pontoon sections are engaged end to end using integral lugs and sockets on the ends of the pontoon sections. Each section has a head located above the main hull portion of the pontoon. Channels engage opposite sides of the heads and extend along the pontoons to ensure the coupling of the pontoon sections. These channels also couple the pontoons to a deck carried on transverse beams joining the channels.

10 Claims, 4 Drawing Sheets

PONTOONS AND PONTOON VESSEL

FIELD OF THE INVENTION

The present invention relates to pontoons and to boats using the pontoons for floatation.

BACKGROUND

Pontoon boats are often used as recreational vessels. Apart from the pontoons, such vessels are relatively easy to construct in numerous configurations. They are usually configured as twin hulled boats with good stability and low draft.

The pontoons for conventional pontoon boats are fabricated as metal shells, usually aluminum, and in one piece. There are certain disadvantages to this type of construction. It is relatively expensive. The pontoons, once fabricated, are relatively large and bulky to transport. Where an aluminum hull is punctured or otherwise damaged, it is difficult and costly to repair. The pontoons must be fabricated individually for vessels of different sizes.

The present invention is therefore concerned with a novel, sectional pontoon.

SUMMARY

According to one aspect of the present invention there is provided a pontoon section comprising a buoyant body having a shell of thermoplastic material with two end walls, one of said end walls having integral lug means projecting therefrom, and the other said end walls having a socket means therein for receiving the lug means of another, similar pontoon section.

The thermoplastic pontoon shell is light weight and rugged. It can easily be molded using for example, a rotational molding technique. Using the lug and socket arrangement, the pontoon sections may be connected end to end with bow and stern sections to form pontoons in varying lengths.

The invention also provides vessels manufactured using the pontoons. According to this aspect of the invention there is provided a vessel comprising at least two pontoons, each pontoon having at least one centre section, a bow section and a stern section arranged end to end, with adjacent ends of the sections having interengaging lugs and sockets, and a deck mounted on the pontoons.

According to a further aspect of the present invention there is provided a pontoon comprising a plurality of pontoon sections arranged end to end, each section comprising an integral, thermoplastic shell having a hull portion and a head portion extending along the top of the hull portion, and a groove along each side of the pontoon section, between the head portion and the hull portion, and coupling means coupling the pontoon sections together, the coupling means comprising elongate members engaged in the grooves.

The elongate members are preferably oppositely facing channels, capturing the head portions of the pontoon sections between them and fastened to transverse beams that support the vessel deck.

BRIEF DESCRIPTION OF THE DRAWINGS

In the accompanying drawings, which illustrate an exemplary embodiment of the present invention.

DETAILED DESCRIPTION

Figure 1:
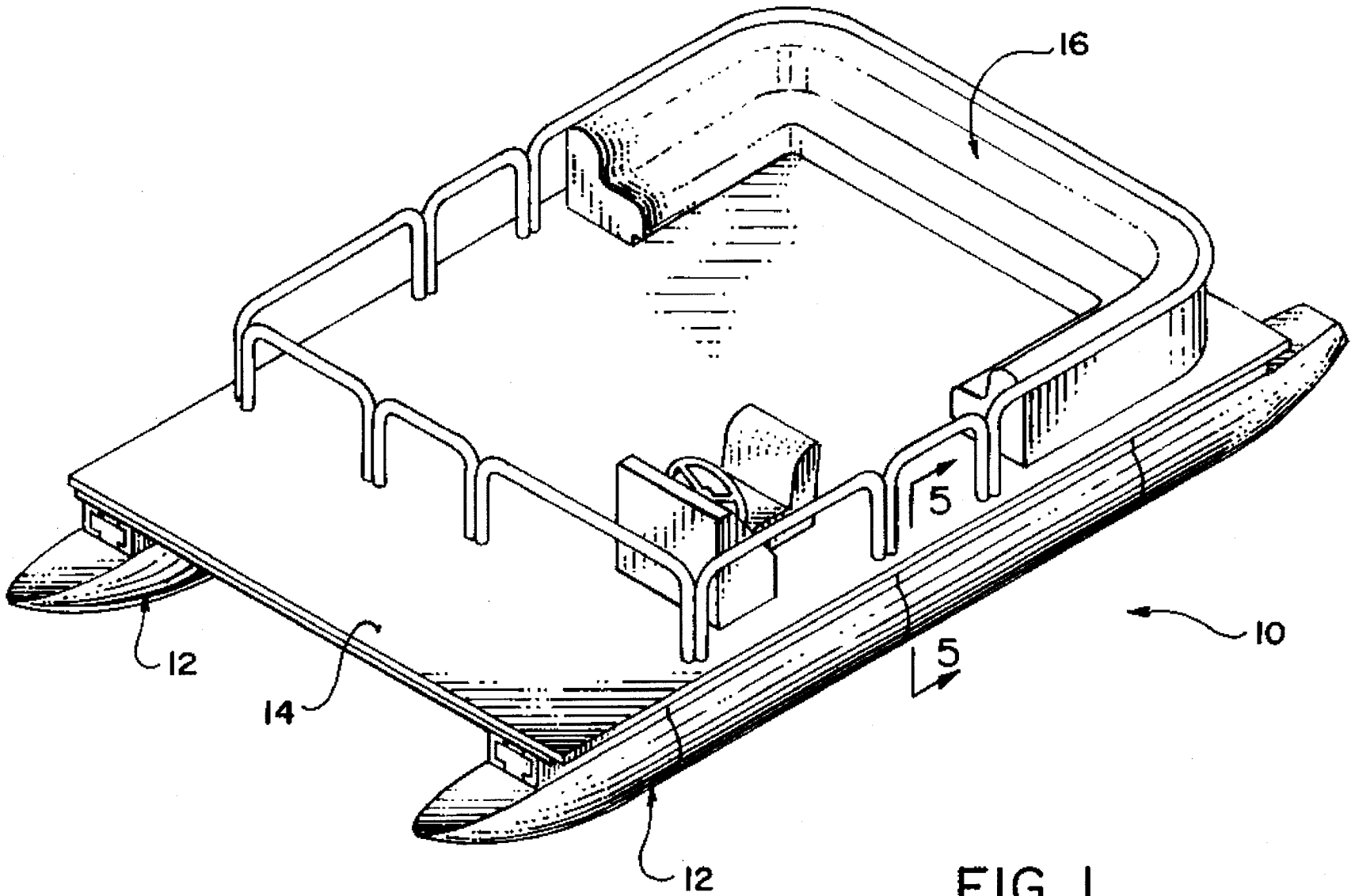
FIG. 1 is an isometric view of a pontoon boat.
Figure 2:
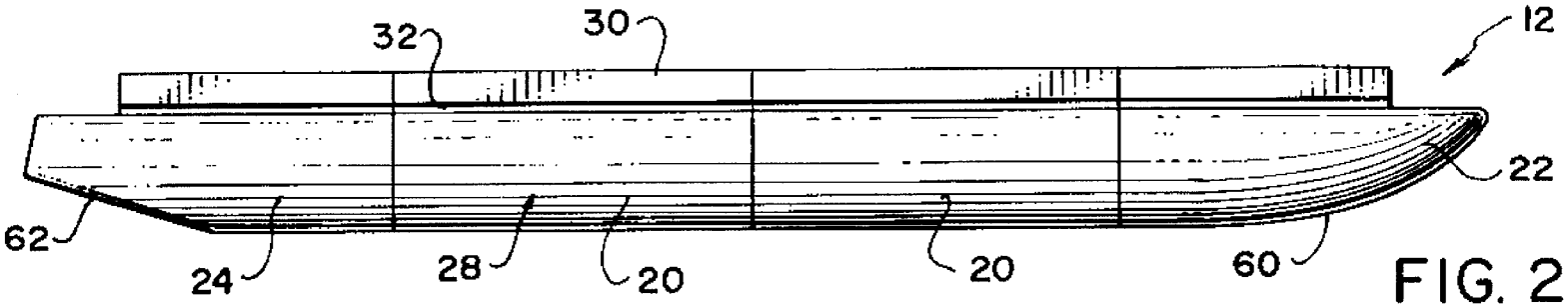
FIG. 2 is a side elevation of a pontoon.
Figure 3:
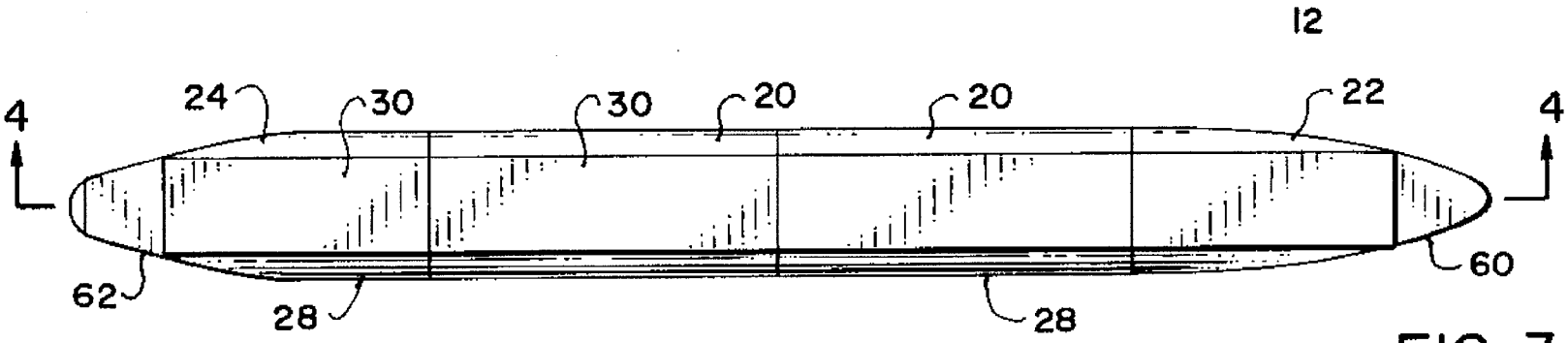
FIG. 3 is a plan view of a pontoon.

Referring to the accompanying drawings, and most particularly to FIG. 1, there is illustrated a boat 10 having floatation provided by two transversely spaced pontoons 12. A flat, rectangular deck 14 is supported on the two pontoons. The deck carries various furnishings 16 such seating, an operator's console and the like. The boat is driven by a motor (not shown). The pontoons of the boat are illustrated most particularly in FIGS. 2 through 7. Each pontoon includes two centre sections 20, a bow section 22 and a stern section 24, all arranged end to end to provide an elongate pontoon. As illustrated most particularly in FIGS. 4 and 5, each pontoon is manufactured as a thermoplastic shell 26, rotationally molded to the desired configuration. The shell includes a hull portion 28 and a head portion 30 that extends along the top of the hull portion. The head portion has a generally rectangular cross-sectional shape and is separated from the hull portion 28 on each side by an elongate groove 32. Each groove 32 receives the bottom flange of an extruded aluminum channel 36. Two of the channels 36 engage opposite sides of the head portion 30 to capture the head portion between them. The upper flanges of the channels are secured to transverse deck beams 38. Gusset plates 40 breaks the channel webs against the under sides of the beams.

Figure 4:
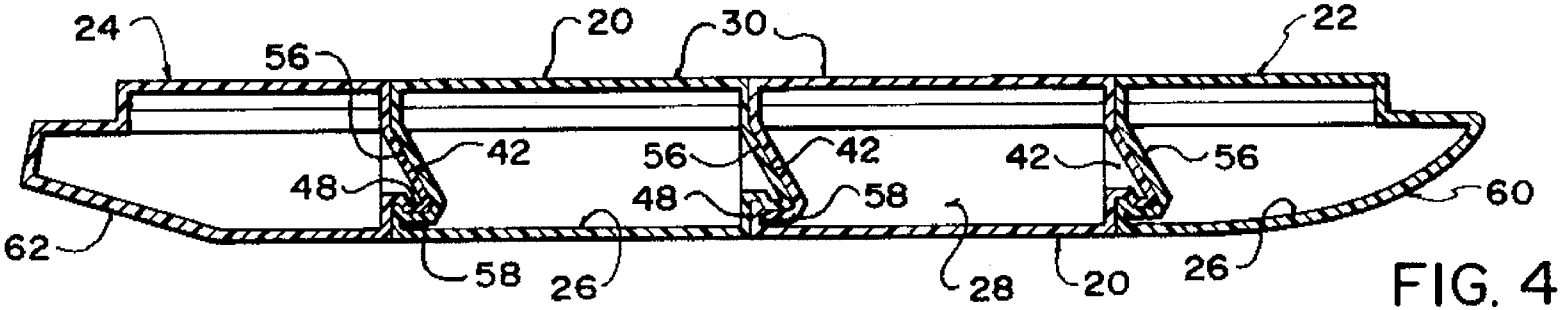
FIG. 4 is a cross-section along line 4—4 of FIG. 3.
Figure 5:
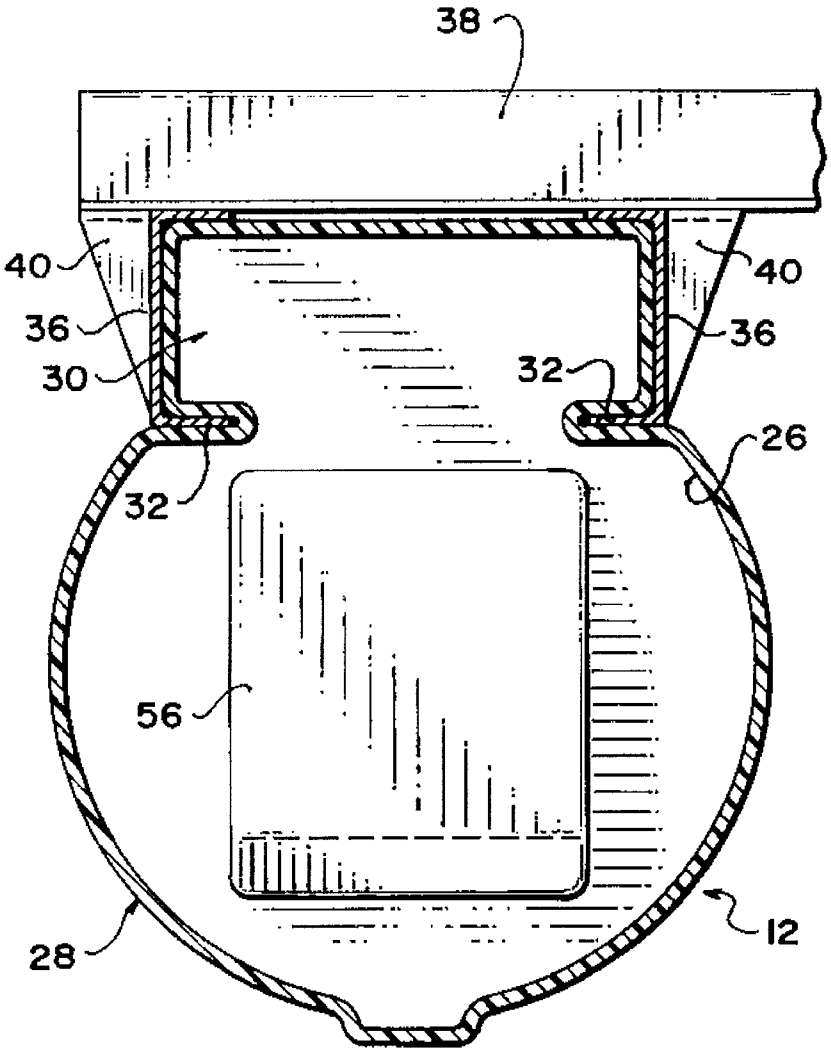
FIG. 5 is a cross-section along line 5—5 of FIG. 1.
Figure 7:
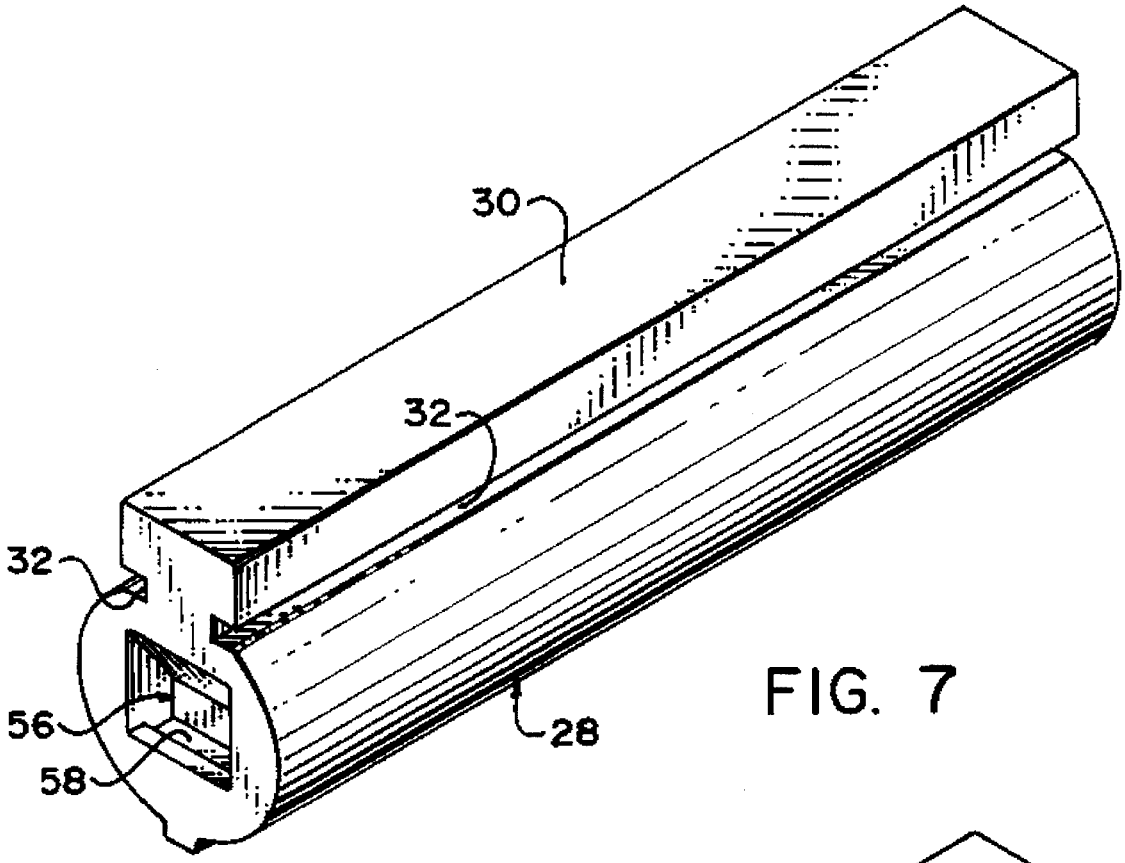
FIG. 7 is an isometric view of a pontoon section from the opposite end.
Figure 6:
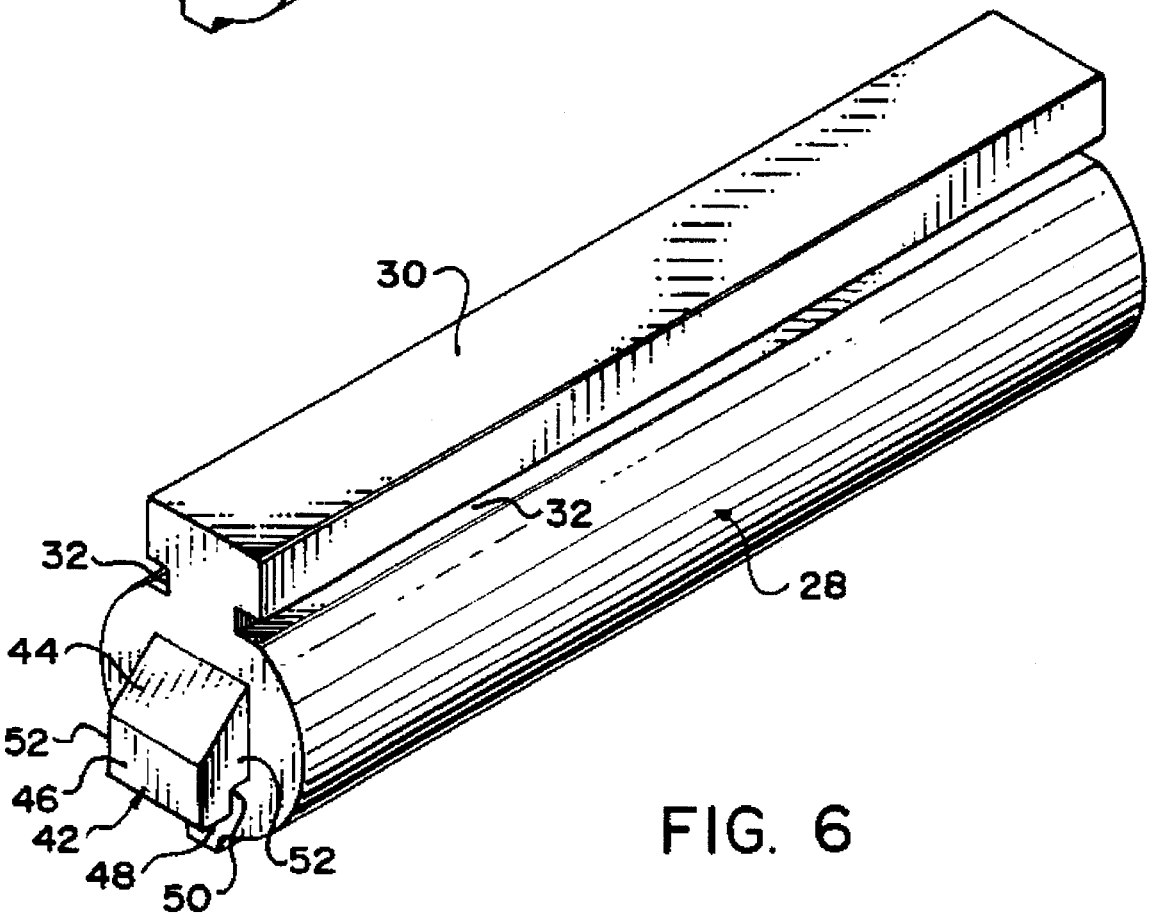
FIG. 6 is an isometric view of a pontoon section from one end.

As illustrated most particularly in FIGS. 4 and 6, the front end of each pontoon section, except the bow section, has an integral lug 42 projecting forwardly from the section. The lug has a top panel 44 that slopes downward to the front, a generally vertical end panel 46 and a stepped bottom panel 48 that provides a recess 50 in the bottom of the lug. The lug has two flat side panels 52. The back end of each pontoon section, with the exception of the stern section, has a mating socket 56. As shown most particularly in FIG. 4, the lugs fit into the mating sockets with the stepped bottom panel 58 of the socket engaging with the stepped bottom panel 48 of the lug in order to retain the pontoon sections against longitudinal separation. The lug and socket interengagement also provides a rotational lateral alignment of the sections. The channels 36, as described above, also serve to couple the pontoon sections to ensure that they are not inadvertently disengaged from one another.

The bow section 22 of the pontoon has an upturned leading end 60, while the stern section 24 has a tapering stern 62.

In constructing a vessel using the pontoon sections, pontoons of various lengths can be assembled depending on the number of center pontoon sections employed in the construction. The sections may be made in standard lengths, for example up to four feet that are relatively easily to transport from place to place so that the vessels may be transported in a "knocked down" condition for subsequent assembly by the purchaser or by a regional distributor. The material used for the pontoons may be any of a number of suitable thermoplastics. One particularly suitable material is high density polyethylene, which is a rugged material resistant to inadvertent damage.

Figure 8:
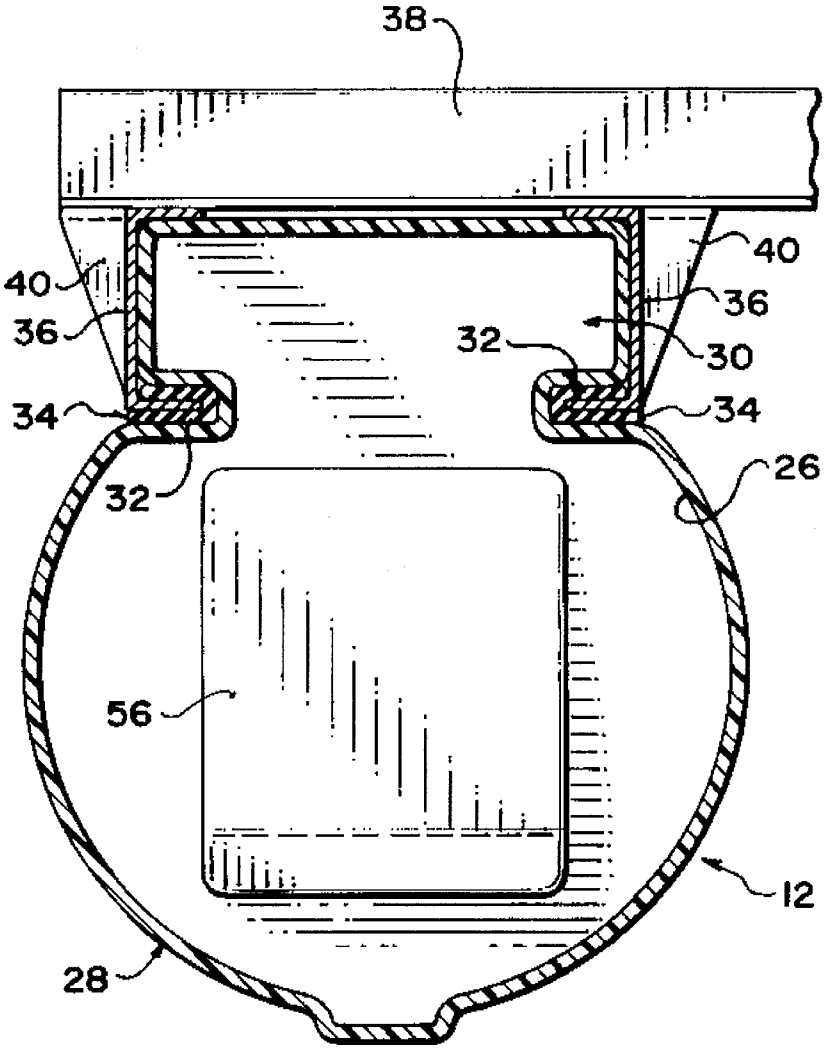
FIG. 8 is a view like FIG. 5 showing an alternative embodiment of the invention.

While one particular embodiment of the present invention is described in the foregoing, it is to be understood that other embodiments are possible. In one alternative embodiment, illustrated in FIG. 8, rubber inserts 34 are used in the grooves 32 to accommodate a shallower channel flange with some cushioning.

It is to be understood that the scope of the invention is to be ascertained solely by reference to the appended claims.

We claim:

1. A pontoon comprising a plurality of pontoon sections arranged end to end and coupling means coupling the sections, the pontoon sections including at least one centre section, a bow section and a stern section, each section comprising a buoyant body having an integral, hollow shell of thermoplastic material, the shell including a hull portion and a hollow head portion positioned above the hull portion, the head portions engaging end to end and forming a continuous head extending along all of the pontoon sections, the coupling means comprising two elongate channels extending along the pontoon, the two channels engaging opposite sides of the continuous head, with each channel engaging over a respective side of the head portion of each pontoon section.

2. A pontoon according to claim 1, with each center section comprising two end walls, one of said end wails having integral lug means projecting therefrom, and the other said end walls having a socket means therein for receiving the lug means of another, similar pontoon section.

3. A pontoon according to claim 2, wherein the bow section has a rear end wall and the stern section has a front end wall, one of the rear end wall of the bow section on the front end wall of the stern section having integral lug means projecting therefrom for engagement in the socket means of the centre section, and the other of the rear end wall of the bow section and the front end wall of the stern section having socket means therein for receiving the lug means of the centre section.

4. A pontoon according to claim 2 wherein the deck comprises transverse beam members extending transversely of the pontoons, above the head portions, the beam members being secured to the channels.

5. A pontoon according to claim 1 including transverse beam members extending transversely of the pontoon sections, above the head portions, the beam members being secured to the channels.

6. A vessel comprising at least two pontoons, each pontoon having at least one centre section, a bow section and a stern section arranged end to end, and coupling means coupling the pontoon sections together, each pontoon section comprises an integral, hollow shell of thermoplastic material, the shell including a hull portion and hollow head portion positioned above the hull portion, the head portions engaging end to end and forming a continuous head extending along all of the pontoon sections, and the coupling means comprising two elongate channels extending along the pontoon, the two channels engaging opposite sides of the continuous head, with each channel engaging over a respective side of the head portions of each pontoon.

7. A vessel according to claim 6, with adjacent ends of the sections having interengaging lugs and sockets, and a deck mounted on the pontoons.

8. A vessel according to claim 7 wherein each pontoon section comprises an integral thermoplastic shell.

9. A pontoon comprising a plurality of pontoon sections arranged end to end, each section comprising an integral, hollow thermoplastic shell having a hull portion and a head portion extending along the top of the hull portion, and a groove along each side of the pontoon section, between the head portion and the hull portion, and coupling means coupling the pontoon sections together, the coupling means comprising two channel sections, each with a bottom flange engaged in a respective one of the grooves of each pontoon section, a web extending along a respective side of the pontoon section head portion and a top flange extending along the tops of the head portions.

10. A pontoon according to claim 9 including cross members secured to the channels.

* * * * *